United States Patent [19]

Lamb

[11] 3,950,788

[45] Apr. 20, 1976

[54] HEAD AND CROWN SUSPENSION FOR PROTECTIVE HELMET

[76] Inventor: Charles Carlisle T. Lamb, 22 Reynolds St., Oakville, Ontario, Canada

[22] Filed: Nov. 18, 1974

[21] Appl. No.: 524,422

Related U.S. Application Data

[62] Division of Ser. No. 430,297, Jan. 2, 1974, Pat. No. 3,878,562.

[30] Foreign Application Priority Data

May 17, 1973 Canada ..... 171686

[52] U.S. Cl. ..... 2/3 R

[51] Int. Cl.[2] ..... A42B 1/08

[58] Field of Search ..... 2/3 R; 24/204, 208 A

[56] References Cited

UNITED STATES PATENTS

| | | | |
|---|---|---|---|
| 1,310,119 | 7/1919 | Harper | 24/208 A X |
| 1,479,150 | 1/1924 | Mellus | 24/208 A X |
| 2,397,801 | 4/1946 | Mitchell | 24/204 |
| 2,709,290 | 5/1955 | Rosenthal | 24/208 A X |
| 3,026,523 | 3/1962 | Bowers et al. | 2/3 R |
| 3,046,559 | 7/1962 | Cox et al. | 2/3 R |
| 3,087,165 | 4/1963 | Cairns | 2/3 R |
| 3,354,468 | 11/1967 | Bowers | 2/3 R |
| 3,430,260 | 3/1969 | Johnson et al. | 2/3 R |

FOREIGN PATENTS OR APPLICATIONS

| | | | |
|---|---|---|---|
| 1,232,367 | 4/1960 | France | 24/204 |

*Primary Examiner*—Alfred R. Guest

*Attorney, Agent, or Firm*—Frank I. Piper; Arne I. Fors; James T. Wilbur

[57] ABSTRACT

The crown suspension consists of upper and lower dome-shaped elements each having a central portion and radially extending legs. The legs of the upper element are connected to the shell and means is provided for adjusting the position of the legs of the lower element relative to the upper element legs to enable the lower element to be fitted to various sized heads.

3 Claims, 4 Drawing Figures

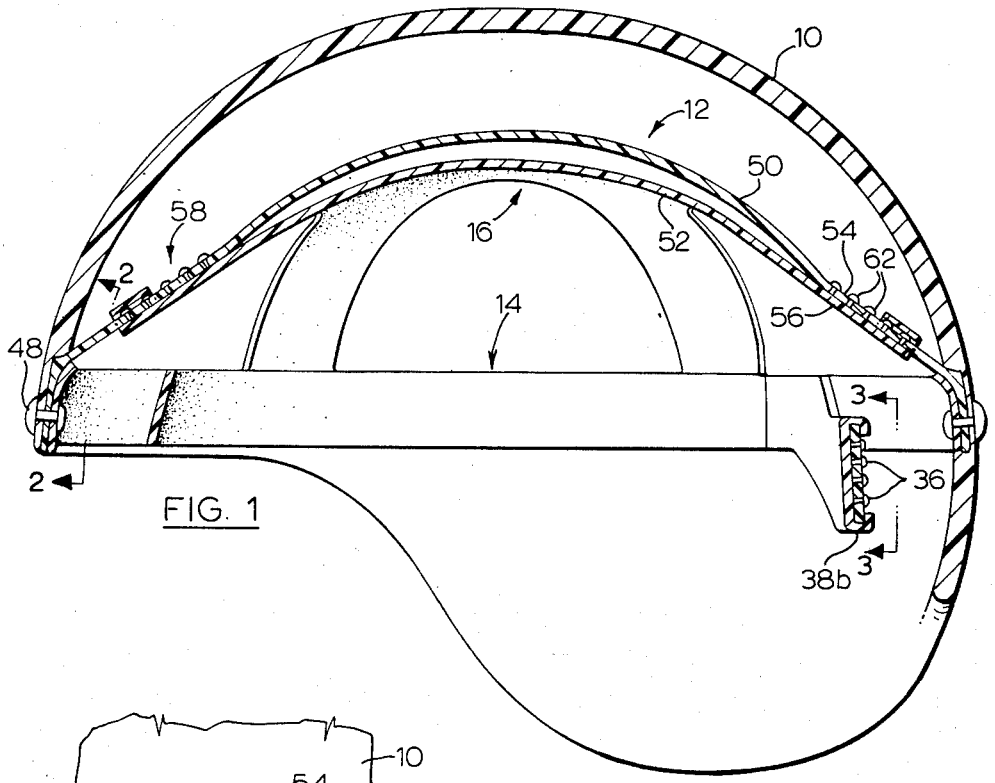
FIG. 1
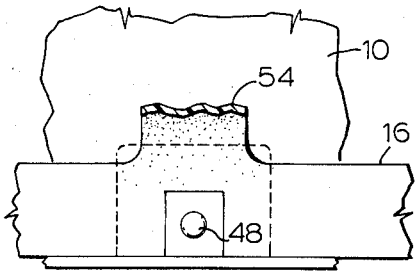
FIG. 2
FIG. 3
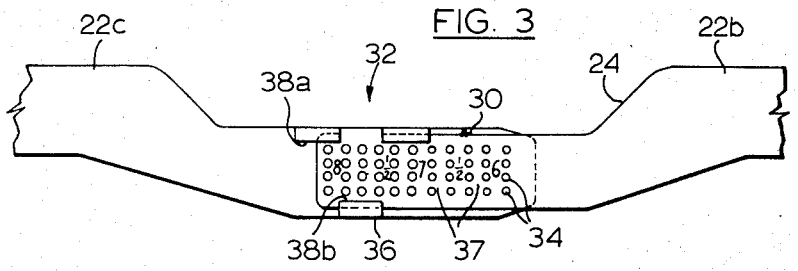

HEAD AND CROWN SUSPENSION FOR PROTECTIVE HELMET

This is a divisional application of application Ser. No. 430,297 filed Jan. 2, 1974 which issued as U.S. Pat. No. 3,878,562 on Apr. 22, 1975.

This invention relates generally to protective hats and more particularly to a novel suspension means or liner for use with helmets. Specifically, the invention is concerned with a suspension means suitable for use with protective helmets and which includes a crown suspension which may be adjusted whereby the suspension means will fit a wide range of head sizes.

Suspension or liners for use with protective helmets usually are composed of two basic parts. One part is generally referred to as the "head suspension" and extends horizontally around the wearer's head at approximately the level of an ordinary hat band. The head suspension serves principally to cushion generally horizontally directed blows on the outer shell of the helmet. The other part is generally referred to as the "crown suspension" and extends over the top of the wearer's head. The latter suspension serves to cushion blows directed generally downwardly against the shell.

A shortcoming of many crown and head suspensions is that they are incapable of preventing the shell from contacting the wearer's head when the outside wall of the shell is struck by a blow. The suspensions do not form a rigid "framework" which will maintain the wearer's head in spaced relationship with the shell but rather will permit the shell to move relative to the head. Such suspensions are not satisfactory for use in helmets worn by participants of contact sports or by construction workers who are exposed to violent blows about their heads.

It is a principal object of the present invention to provide a helmet liner having a crown suspension which effectively absorbs impacts or blows impinging on the helmet and which may be readily adjusted to fit a wide range of head sizes.

It is another object to provide a one-piece head suspension which may be readily molded from plastic or like moldable material and which may be fitted into a protective shell with a minimum of labour.

The crown suspension of the invention consists of: upper and lower dome-shaped elements each having a central portion and radially outwardly extending legs, the legs of the upper element extending to and adapted to be secured to said shell, the legs of the lower element extending along and in contact with said upper element legs but terminating short of said shell, means for adjusting the location of the lower element legs relative to the upper element legs to enable the lower element to be fitted to various sized heads.

The invention will be more fully explained with reference to the drawings which show a preferred embodiment of the head and crown suspensions. In the drawings:

FIG. 1 is an elevation, partly in section, of the suspension means of the invention incorporated in a shell;

FIG. 2 is a view on line 2—2 of FIG. 1;

FIG. 3 is an enlarged fragmentary view on line 3—3 of FIG. 1; and

Like reference characters refer to like parts throughout the description of the drawings.

Figure 4:
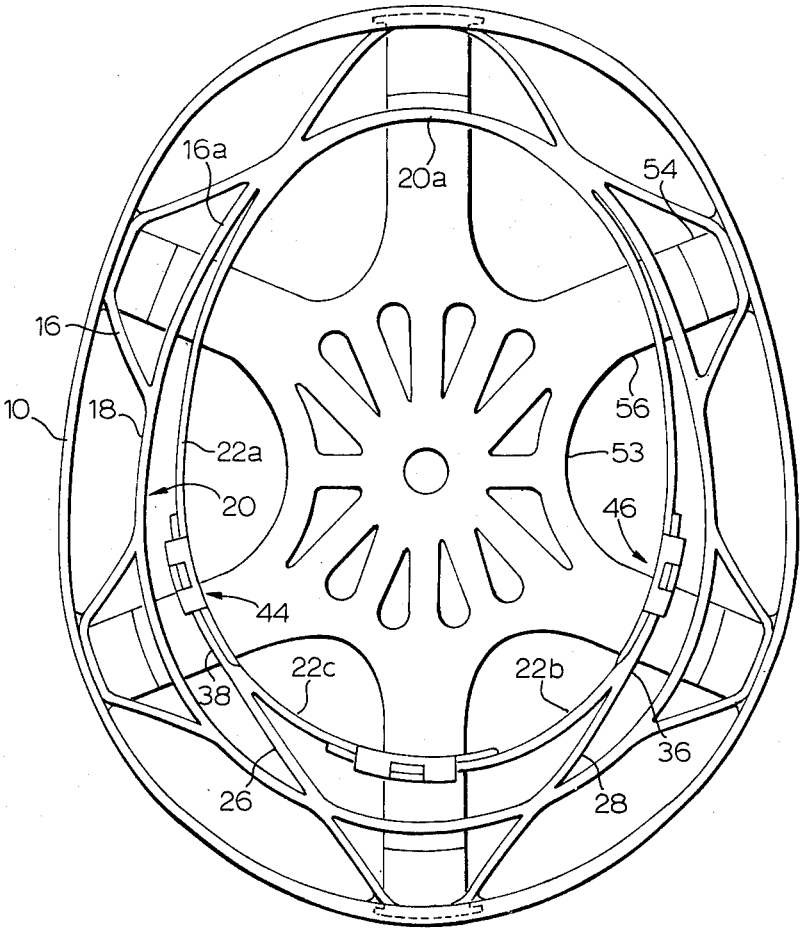
FIG. 4 is an elevation of the suspension means and helmet.

Referring to FIG. 1, the helmet illustrated is of conventional design having a semi-rigid resinous shell 10 and a suspension means, generally 12 to position the shell on a wearer's head in such fashion that it is maintained in spaced relationship with the head to absorb the shock of blows imparted to the external surface of the shell.

The suspension means is composed of a horizontal head-encircling head suspension generally 14 and a crown suspension generally 15. The components of both suspensions are composed of tough inelastic fabric or polymeric material such a polyethylene or rubber. Preferably, the suspension means is of one-piece molded plastic construction. With reference first to the head suspension 14 and to FIG. 4, this suspension includes a continuous one-piece outer strap composed of a plurality of tightly stretched loops 16 and links 18. The loops are spaced apart from one another along the inside wall of the shell and successive loops are interconnected by means of the links 18 which together with the innermost portions or reaches 16*a* or each loop define a smooth continuous band, generally 20 which extends circumferentially within the shell. By means of the loops, the outer band 20 is held rigidly in a position spaced apart from the shell. A continuous inner band or strap 22 extends circumferentially within outer band 20 except for a portion 20*a* thereof which is coextensive with band 20.

The inner band 22 is composed of a first elongated segment 22*a* adapted in use to extend between the two temporal bones or thereabouts and across the forehead or frontal bone of the wearer. A second segment 22*b* overlaps one end of the first segment 22*a* and extends generally horizontally then diagonally downwardly as at 24 (FIG. 3) to contact the base of the occipital bone. The latter segment terminates at a approximately at the rear of the wearer's head. A third segment 22*c* overlaps the end of the second segment and extends to overlap the other end of the first segment 22*a*. The three segments which make up the inner band 22 thus form a continuous ring adapted to contact and to encircle the wearer's head.

The second and third inner band segments 22*b*, 22*c* are attached to the outer band 20 by means of links 26, 28 (FIG. 4).

With reference to FIG. 3, the overlapping end portions of band segments 22*b*, 22*c* are provided with an adjustment means, generally 32 which permits the selective lengthening and shortening of the distance, measured along these band segments, between the points of attachment of these segments with links 26, 28. The adjustment means is composed of a plurality of rows of spaced apertures 34 formed in the overlapping end portion of band segment 22*b*. The The overlapping end portion of band segment 22*c* is provided with spaced outwardly projecting studs 36 (FIG. 1). The spacing of the studs corresponds to the spacing of the apertures to that by moving the end portions of the two band segments relative to one another, the studs are brought into registry with selective apertures 34 along the length of the end portion of band segment 22*b*. The head size with which the various apertures correspond is marked on band segment 22*b* as at 37.

Each of the studs 36 is provided with an enlarged head which is slightly larger than apertures 34. Because the material from which the band is fabricated is resilient and flexible, the enlarged heads can be easily forced through the apertures 34 but at the same time the material is sufficiently resilient so as to maintain the connection until it is desired to separate the two end portions as by pulling them apart.

Extending along each side edge of the end portion of band segment 22*c* is an overhanging guide 38*a*, 38*b* which serves to maintain the two end portions of segments 22*b*, 22*c* in slidable contact with one another.

The overlapping ends of band segments 22*a*, 22*b* and segments 22*a*, 22*c*, are also provided with adjustments means generally 44, 46 respectively of the same construction as that of adjustment means 32. Adjustment means 44 permits variation of the distance, measured along band segments 22*a*, 22*c*, between the point of attachment of segment 22*c* with link 26 and the point of attachment of segment 22*a* with the outer band 20. Adjustment means 46 permits a like variation in the distance measured along segments 22*a*, 22*b*.

With reference again to FIGS. 1 and 2, the outer loop segments 16 are connected to the shell by means of metallic or plastic rivets 48. Rivets 48 also serve to attach the ends of the crown portion 15 to the shell in the manner explained below.

The crown suspension 15 is composed of upper and lower dome-shaped elements 50, 52 respectively, both of which having slitted central vents as shown in FIG. 4 and indicated 53, and legs 54, 56 respectively which radiate outwardly from the central portions. Legs 54 terminate at the shell and are connected thereto by means of rivets 48 while legs 56 terminate short of the shell. Legs 54, 56 are provided with an adjustment means generally 58 (FIG. 1) of the same construction as adjustment means 32 to permit adjustment of the curvature of the lower element 52 to accommodate various head sizes. As shown, the adjustments means is composed of a plurality of rows of spaced apertures 60 formed in each leg 54 for receipt of upwardly extending studs 62 formed in each leg 56. As seen the stud heads are enlarged to maintain the connection until it is desired to separate the upper and lower elements 50, 52.

It will be understood of course that modifications can be made in the embodiments described and illustrated herein without departing from the scope and purview of the appended claims.

What I claim as new and desire to protect by Letter Patent of the United States is:

1. A crown suspension for use within a protective helmet having a shell adapted to encircle a wearer's head and in spaced relationship thereto, said crown suspension consisting of upper and lower dome-shaped elements each consisting of a one-piece member having a central portion and radially outwardly extending legs integral with said central portion, the legs of the upper element extending to and adapted to be secured to said shell, the legs of the lower element extending along and in contact with said upper element legs but terminating short of said shell, means for removably connecting each of said lower element legs to a respective said upper element leg, said connecting means being the one and only means by which said lower and upper element legs are interconnected and having means for adjusting the location of the connection between said lower and upper element legs to enable the lower element to be fitted to various sized heads.

2. The crown suspension as claimed in claim 1 wherein said connecting means for said dome-shaped elements comprises a plurality of apertures formed in a respective one of each of said upper and lower element legs and outwardly extending studs formed in the other of said upper and lower element legs, said studs being releasably engageable in selective said apertures.

3. The crown suspension as claimed in claim 1 wherein said upper and lower dome-shaped elements each have at least six legs, each said leg of each said element being spaced equidistantly from adjacent legs of the same element on opposite sides thereof.

* * * * *